United States Patent [19]

Leighton et al.

[11] Patent Number: 4,484,361

[45] Date of Patent: Nov. 27, 1984

[54] KNEE AND ELBOW PAD AND METHOD OF MAKING

[75] Inventors: Kenneth B. Leighton, Solon; Michael J. Silvestro, Stow, both of Ohio

[73] Assignee: Spectrum Sports, Inc., Twinsburg, Ohio

[21] Appl. No.: 541,703

[22] Filed: Oct. 13, 1983

[51] Int. Cl.[3] ..... A41D 13/00; A41D 13/06

[52] U.S. Cl. ..... 2/24; 2/16; 2/18; 2/20; 2/23; 2/425

[58] Field of Search ..... 2/22, 23, 24, 425, 62, 2/16, 18, 20

[56] References Cited

U.S. PATENT DOCUMENTS

| | | | |
|---|---|---|---|
| 2,553,612 | 5/1951 | Taylor | 2/22 |
| 2,785,407 | 2/1954 | Reeder | 2/22 |
| 3,044,075 | 3/1960 | Rawlings | 2/22 |
| 3,322,118 | 7/1964 | Sotherlin | 2/24 |
| 3,322,873 | 5/1967 | Hitchcock | 2/24 |
| 3,465,364 | 5/1967 | Edelson | 2/22 |
| 3,588,914 | 11/1969 | Ihnat | 2/425 |
| 3,735,419 | 5/1973 | Byrd | 2/22 |
| 4,292,263 | 9/1981 | Hanrahan et al. | 2/23 |
| 4,346,205 | 8/1982 | Hites | 528/53 |
| 4,354,280 | 10/1982 | Hayes | 2/24 |

FOREIGN PATENT DOCUMENTS

| | | | |
|---|---|---|---|
| 2362044 | 12/1973 | Fed. Rep. of Germany | 2/22 |
| 2506132 | 11/1982 | France | 2/24 |
| 1562191 | 3/1980 | United Kingdom | 2/22 |
| 1572159 | 7/1980 | United Kingdom | 2/22 |
| 2073009 | 10/1981 | United Kingdom | 2/22 |

*Primary Examiner*—Werner H. Schroeder
*Assistant Examiner*—Mary A. Ellis
*Attorney, Agent, or Firm*—Maky, Renner, Otto & Boisselle

[57] ABSTRACT

An elbow or knee pad and a method of making the same are disclosed. The pad includes an elasticized sleeve to surround the joint to be protected and a pad assembly fastened to the sleeve. The pad assembly includes a fabric covering over a polyurethane foam backing. A recess is formed in the polyurethane by pressing a hot die into it and a dense, modified polyurethane is cast in the recess. The combination of polyurethane foam and dense, modified polyurethane provides superior shock absorption and protection from impact.

12 Claims, 3 Drawing Figures

KNEE AND ELBOW PAD AND METHOD OF MAKING

BACKGROUND OF THE INVENTION

The present invention relates to pads for protecting knees and/or elbows.

Knee and elbow pads have been used to protect the respective joints of athletes and others whose joints could be adversely affected by impact. Some elbow and knee pads have been formed with an elastic sleeve to which a resilient pad is attached. The sleeve surrounds the joint to be protected holding the pad in the desired location.

U.S. Pat. No. 4,346,205 discloses a polymeric material stated to be useful in sportswear including shin pads and athletic shoes. The material disclosed and claimed in this patent is a flexible non-cellular polyurethane of essentially linear structure containing unsatisfied hydroxyl groups, having a compression set of less than 15% and preferably less than 5%, an elongation at break of at least 500%, a recovery after compression which is delayed by at least 0.7 seconds, and a hardness on the Shore 00 scale not exceeding 50 and most preferably in the range of 0 to 10.

SUMMARY OF THE INVENTION

The present invention provides a new and improved pad for a knee or elbow which more effectively absorbs shock and therefore more effectively protects the joint than prior art pads. According to the present invention a knee or elbow pad includes an elastic sleeve adapted to surround the joint to be protected. A pad is stitched onto the outside of the sleeve to provide the desired protection. The pad includes an outer fabric layer which is laid over a polyurethane foam backing. A recess is formed in the foam backing and a dense, modified polyurethane similar to that disclosed in U.S. Pat. No. 4,346,205 is cast in place in the recess. The recess is positioned and contoured so that when filled with the modified, dense polyurethane the more vulnerable areas in the joint are protected.

The invention, then, comprises the features hereinafter fully described and particularly pointed out in the claims, the following description and annexed drawing setting forth in detail an illustrative embodiment of the invention, this being indicative, however, of but one of the various ways in which the principles of the present invention may be carried out.

DESCRIPTION OF THE PREFERRED EMBODIMENT

Figure 1:
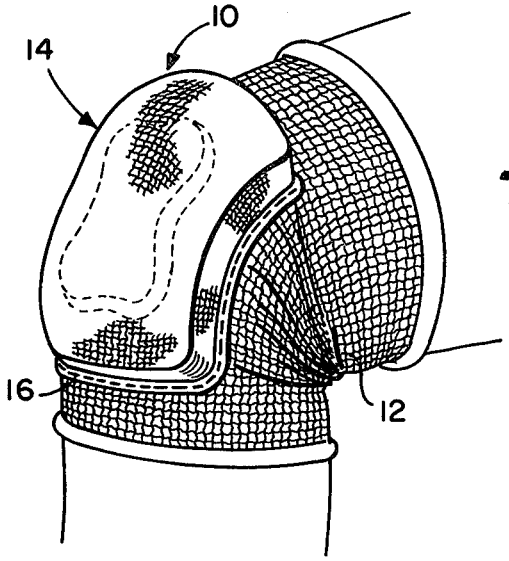
FIG. 1 illustrates a knee or elbow pad constructed in accordance with the present invention on the flexed knee of a wearer.

The knee or elbow pad 10 (FIG. 1) constructed in accordance with the present invention includes an elasticized sleeve 12 proportioned to surround and grip a joint to be protected. A pad assembly 14 is secured by stitching 16 around its perimeter to the sleeve 12. The pad 10 is useful in protecting knees and elbows from injuries that could occur in activities such as football, wrestling, volleyball, basketball, or other athletic endeavors. Additionally, the pad 10 may find uses in post-surgical situations where even a small impact could damage a joint.

Figure 2:
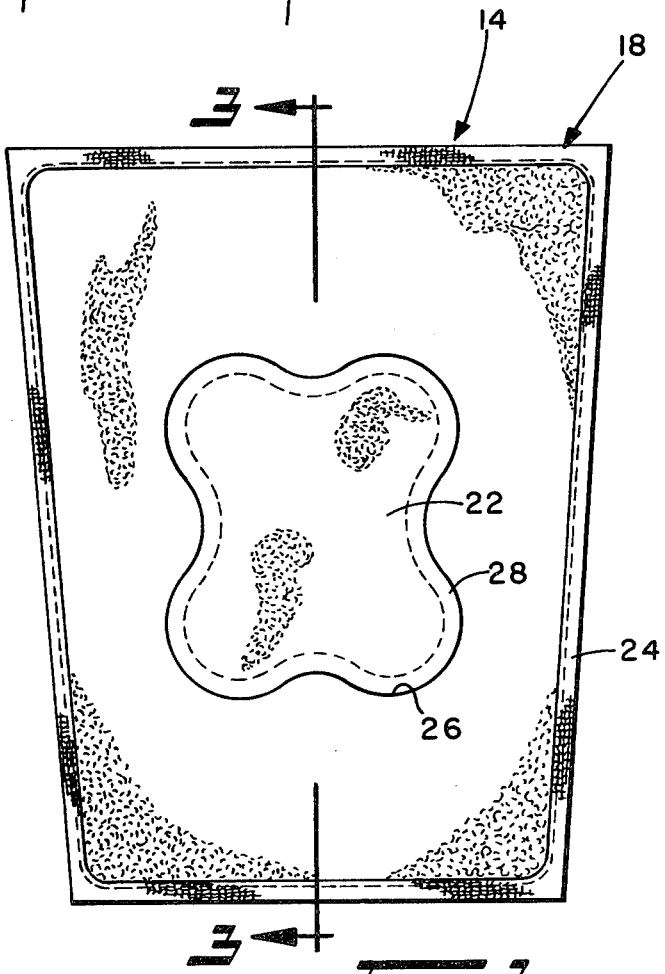
FIG. 2 illustrates a plan view of a portion of the pad of FIG. 1.
Figure 3:
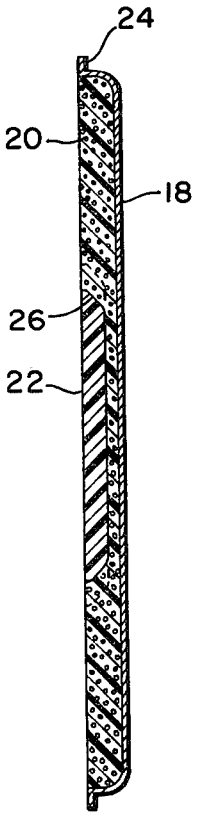
FIG. 3 is a sectional view looking in the direction of arrows 3—3 of FIG. 2.

The pad assembly 14 (FIGS. 2 and 3) includes an outer fabric covering 18, a polyurethane foam backing 20, and a dense, modified polyurethane insert 22. The foam backing 20 is made preferably of polyurethane foam with a hardness on the Shore 00 scale of between 30 and 60, although other foamed plastics with similar properties may be used. The backing 20 is made trapezoidal in shape with the parallel sides being spaced apart between about 5 and about 7 inches, depending on the size of the joint to be protected. The longer of the two parallel sides of the backing ranges from about 4 to about 6 inches while the shorter of the parallel sides ranges from about 4 to about 5 inches, again depending on joint size.

The fabric covering 18 surrounds the foam backing 20 and includes a peripheral portion 24 which extends outward from the edges of the trapezoidal backing 20. The stitching 16 (FIG. 1) connects the peripheral portion 24 of the fabric covering to the sleeve 12.

The insert 22 is received in a recess 26 centrally formed in the backing 20. The backing 20 may have a maximum thickness of approximately $\frac{3}{8}$ inch, while the recess 26 is approximately 0.2 inches deep with its side walls inclined at a 45° angle to the major side surfaces of the backing 20. The recess 26 is formed by pressing a hot die into the polyurethane foam of which the backing 20 is formed. The hot die melts the foam in the area where the recess 26 is to be formed and forms a skin on the surface of the recess.

The insert 22 is formed of a material similar to that disclosed in U.S. Pat. No. 4,346,205, the disclosure of which is incorporated herein by reference. However, it is preferred in carrying out the present invention that the modified, dense polyurethane used to make the insert 22 have a hardness on the Shore 00 scale of between 20 and 70. Said U.S. patent discloses a modified, dense polyurethane having a hardness not exceeding 50 and preferably not exceeding 20 and most preferably in the range of 0 to 10. In order to form the polyurethane of the present invention it is necessary to decrease the percentage of unsatisfied hydroxyl groups from about 1 in 5 in the aforementioned U.S. patent to approximately 1 in 4.

The resulting material is a flexible, non-cellular polyurethane of essentially linear structure containing unsatisfied hydroxyl groups. The material has a compression set of less than 15% and preferably less than 5%. Its elongation at break is at least 500%, and after compression its recovery is delayed by at least 0.7 seconds. The insert 22 may be cast in place into the recess 26 formed in the backing 20. This assures an intimate bonding with the surrounding polyurethane foam.

The recess 26 may take a variety of shapes, but the four-lobed shape illustrated is preferred. The four-lobed shape of insert 22 may be visualized as a rectangle with rounded corners and inwardly curving or concave sides.

The knee or elbow pad of the present invention provides improved impact protection. For impacts not centered directly on the joint the foam backing 20 provides adequate protection. For blows directed directly at the joint the insert 22 of elastomeric material provides superior energy absorbing properties thereby protecting especially the joint. Because the recovery after impact of the insert is delayed, there is little rebound. Impact energy is dissipated by lateral displacement of the material of the insert 22 and by compression thereof in a manner which is entirely unique. The combination of polyurethane foam and dense polyurethane is unique also and provides maximum possible protection to the joint.

The following is claimed:

1. An elbow or knee pad comprising a pad assembly having a foam backing with a recess and a dense, modified polyurethane insert in said recess, said backing being a polyurethane foam, and said dense modified polyurethane insert being formed of a non-cellular polyurethane of essentially linear structure containing unsatisfied hydroxyl groups, having a compression set of less than 15% and elongation at break of at least 500%, and a recovery which is delayed after compression by at least 0.7 seconds.

2. The pad of claim 1 wherein said polyurethane foam backing has a hardness on the Shore 00 scale of between 40 and 50.

3. The pad of claim 2 wherein said modified polyurethane has a Shore hardness measured on the 00 scale of between 20 and 70.

4. The pad of claim 3 including an elasticized sleeve, and said pad assembly having a fabric covering connected with said sleeve.

5. The pad of claim 1 wherein said recess is defined by a skin of polyurethane.

6. An elbow or knee pad comprising a pad assembly having a foam backing with a recess and a dense, modified polyurethane insert in said recess, said recess having a four-lobed shape.

7. The pad of claim 6 wherein said recess has a beveled side wall.

8. A method of making an elbow or knee pad comprising the steps of forming a foam backing, forming a recess in said backing, and forming a dense, modified, polyurethane insert to fit in said recess, said step of forming a recess including the step of pressing a hot die into said polyurethane foam.

9. The method of claim 8 including the step of covering said backing with a fabric covering.

10. The method of claim 8 wherein said step of forming an insert includes the step of casting a dense, modified polyurethane in said recess.

11. The method of claim 10 wherein said step of casting a dense, modified polyurethane in said recess includes casting a polyurethane having unsatisfied hydroxyl groups, a compression set less than 15%, an elongated at break of at least 500%, and a recovery which is delayed after compression by at least 0.7 seconds.

12. The method set forth in claim 8 wherein the step of pressing a hot die into said polyurethane foam melts said polyurethane foam to form a skin defining said recess into which said dense, modified polyurethane is cast.

* * * * *